US005131376A

United States Patent [19]

Ward et al.

[11] Patent Number: 5,131,376

[45] Date of Patent: Jul. 21, 1992

[54] DISTRIBUTORLESS CAPACITIVE DISCHARGE IGNITION SYSTEM

[75] Inventors: Michael A. V. Ward, Lexington; Winfield Hill, Brookline; Fred Kern, Lexington, all of Mass.

[73] Assignee: Combustion Electronics, Inc., Arlington, Mass.

[21] Appl. No.: 684,595

[22] Filed: Apr. 12, 1991

[51] Int. Cl.[5] ..... F02P 3/06

[52] U.S. Cl. ..... 123/598; 123/597

[58] Field of Search ..... 123/598, 597; 331/112, 331/146, 147, 148, 149; 315/209 T, 209 CD, 209 SC

[56] References Cited

U.S. PATENT DOCUMENTS 4,502,454 3/1985 Hamai et al. ..... 123/597

4,998,526 3/1991 Gokhale ..... 123/598

*Primary Examiner*—Raymond A. Nelli

*Attorney, Agent, or Firm*—Jerry Cohen

[57] ABSTRACT

A high power high energy distributorless ignition system for multicylinder internal combustion engines using a single energy storage capacitor (4), a single leakage resonating inductor (20) with a switch SS partially or entirely across it, and one or more coils Ti with bi-directional switches Si and with single or double hith voltage outputs, the system defining a compact coil assembly powered by a resonant converter power supply (12), the ignition power delivery controlled by means of circuitry based on a robust gate (17), an oscillator (19), and steering circuitry (21).

28 Claims, 6 Drawing Sheets

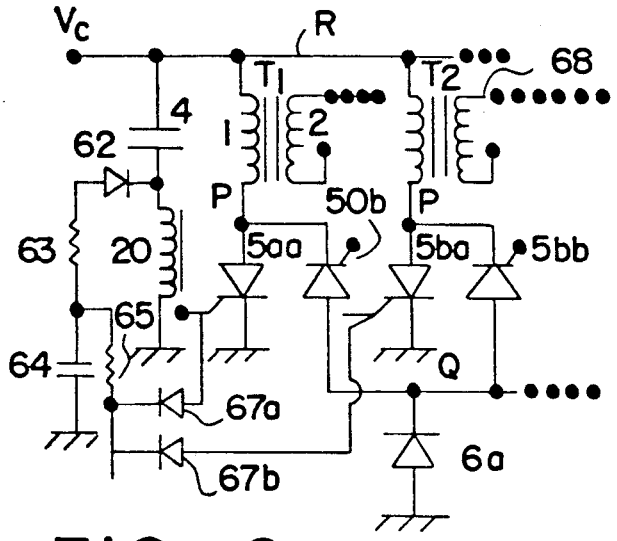
FIG. 2
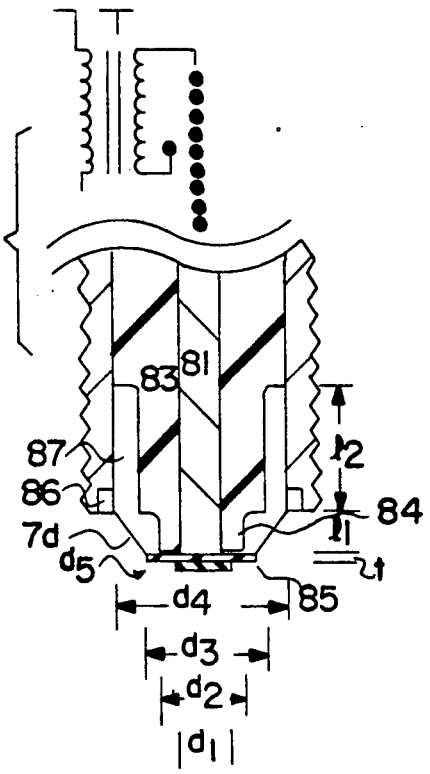
FIG. 3
| | typ. | min. | max. |
|---|---|---|---|
| $d_1$ | 0.1" | 0.09 | 0.125 |
| $d_2$ | 0.21" | 0.20 | 0.22 |
| $d_3$ | 0.28" | 0.26 | 0.30 |
| $d_4$ | 0.37" | 0.34 | 0.40 |
| $\ell_1$ | 0.10" | 0.06 | 0.18 |
| $\ell_2$ | 0.25" | 0.10 | 0.8 |
FIG. 4
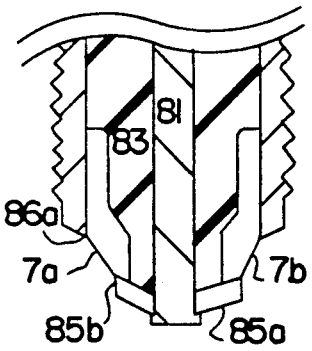
FIG. 3a

DISTRIBUTORLESS CAPACITIVE DISCHARGE IGNITION SYSTEM

BACKGROUND OF THE INVENTION AND PRIOR ART

The present invention relates to ignition systems for internal combustion engines, and particularly high power, high energy distributorless capacitive discharge ignition systems for multi cylinder engines. Such ignition is essential to the operation of high efficiency internal combustion engines using the more difficult to ignite dilute mixtures, such as lean mixtures, high residual or high EGR mixtures, and fuel-air mixtures of the more difficult to ignite fuels such as alcohol fuels, natural gas, and others. Such high power, high energy ignition delivers power to the mixture at the rate of hundreds of watts versus tens of watts for conventional inductive ignition and conventional high energy ignition. Total useful energy delivery to the mixture ranges from about fifty millijoules to several hundred millijoules, versus five to twenty millijoules for conventional high energy ignition.

The distributorless feature of the ignition is achieved by the use of a separate leakage inductor disclosed in the prior and copending U.S. patent application Ser. No. 7-350,945, and the high power/high energy feature by the use of the voltage doubling principle disclosed in U.S. Pat. No. 4,677,960 and its improvements. The ignition control system is based in part on U.S. Pat. No. 4,688,538. U.S. Pat. Nos. 4,774,914, 4,841,925, and 4,868,730 are also relevant to other features presented herein including improved power converter and energy recharge circuit, SCR speed-up turn-off circuit, and others. Also, plasma jet type ignition of U.S. Pat. No. 4,317,068 is referenced since it is improved by features disclosed herein. The said application and all said patents are of common assignment with this application and the text and drawings of said prior application and patents are incorporated herein by reference as though set out at length herein.

Reference to the above cited application and patents is sometimes made herein as '945 application, and '960, '538, '914, '925, '730, and/or '068 patent(s), respectively.

SUMMARY OF THE INVENTION

The present invention features a distributorless capacitive discharge ignition system for multi cylinder engines including high power high efficiency DC to DC power converter and control circuitry, high efficiency high power recharge circuit with optional control switch, fully switched (bi-directional) distributorless ignition with resonating leakage inductor and compact coils operated by steering control circuitry, and overall control circuitry for the ignition system which is preferably operated as a gate operated multi-pulsing circuit with modulation of the spark pulses per ignition firing.

A new feature of the invention is the shorting out of part or all of the resonating leakage inductor during the first half cycle of the first discharge spark pulse to raise the high voltage open circuit frequency and hence permit further reduction in size of the high voltage compact coils of the ignition. Also featured are preferred toroidal gap type spark plugs with preferred dimensions of the spark firing end.

A principal object of the present invention is the use of principles and features of the inventions cited above with certain new principles and features disclosed herein to provide a robust and versatile ignition system for single and multi cylinder engines able to deliver high power, e.g. order of 100 watts, for a variable duration of sufficient time to deliver tens to hundreds of millijoules of total energy to the air-fuel mixture to insure the ignition of difficult to ignite mixtures. Preferably, the energy is delivered in the form of a pulse train of spark pulses of essentially constant amplitude, with time between pulses of 100 to 500 microseconds with an overall duration of 1 to 20 milliseconds, and preferably delivered by a plug with a toroidal gap allowing the spark pulses to move around its periphery with very low erosion of the plug tip.

Another object of the invention is to use the principles and features disclosed herein to produce small and inexpensive compact coils for use in the high power, high energy ignition.

Other features and objects of the invention will be apparent from the following detailed description of preferred embodiments taken in conjunction with the accompanying drawings.

BRIEF DESCRIPTION OF THE DRAWINGS

FIG. 2 is a circuit drawing implementing a preferred method of providing a bi-directional SCR based switch for the compact coils of the distributorless feature of the invention.

FIGS. 3 and 3*a* are fragmentary views of preferred toroidal gap spark plugs for use with the ignition.

FIG. 4 is a table of preferred values of parameters defining the toroidal spark gap.

DESCRIPTION OF PREFERRED EMBODIMENTS

Figure 1:
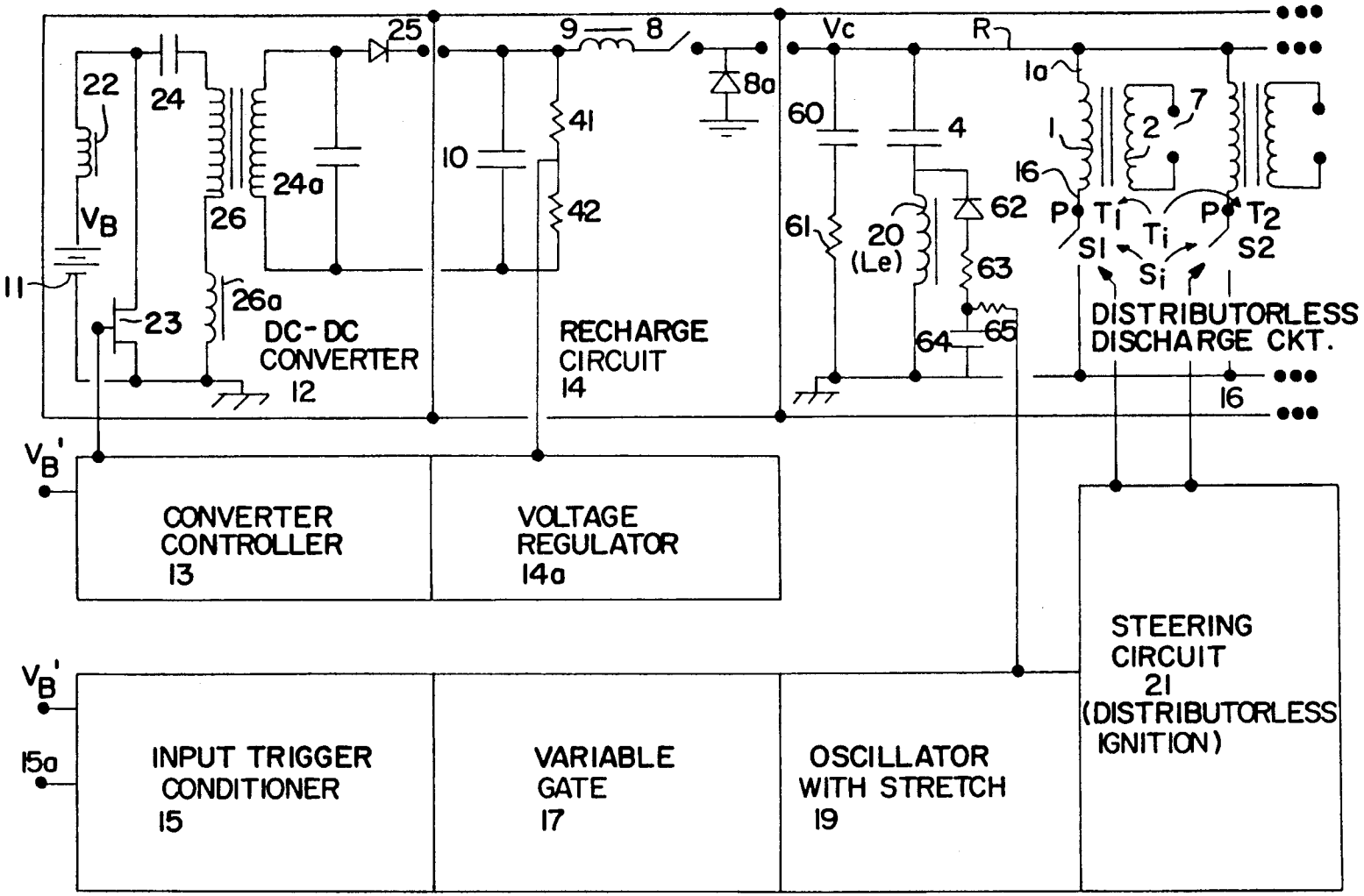
FIG. 1 is a circuit block diagram including some detailed circuitry of a preferred embodiment of the entire ignition system.

FIG. 1 is a circuit block diagram of the distributorless ignition system depicting two of an arbitrary number of compact coils T1, T2 with bi-directional switches S1 and S2. The main elements of the ignition are the DC-DC converter 12 (connected to a battery 11) and its controller 13, recharge circuit 14 and voltage regulator 14a using resistors 41 and 42, distributorless discharge circuit 16, input trigger conditioner 15, variable gate 17 and (trigger) oscillator with stretch 19, and the steering circuit 21 for triggering each switch Si of coil Ti in turn, where i=1,2,3, . . .

For the DC-DC converter the resonant converter of patent '730 is shown with its transformer 26 with leakage inductance 26a, input choke 22, input capacitor 24, the preferred field-effect transistor, or FET switch 23, output capacitor 24a, and output diode means 25. In a preferred embodiment, no input diode is placed in series with choke 22 which is accomplished by an FET 23 switching waveform with an ON-time (FET is ON) somewhat longer than the FET OFF-time, which does not permit capacitor 24 to begin to discharge in the reverse direction after it has become partially or fully charged.

An alternative equivalent topology of the resonant converter 12 can be constructed which resembles a fly-back converter in that switch 23 is placed in series with a transformer 26 and battery 11 (instead of shunting the battery), input choke 22 is eliminated (it is built into the transformer), and capacitor 24 is transformed (mapped) to the output side (and hence eliminated from the primary circuit). Unlike the flyback converter, transformer leakage inductor 26a has a relatively high inductance (versus a minimum leakage in the case of the flyback). Capacitor 24 is transformed (mapped) into the secondary side in series with the secondary winding and has a transformed value equal to the primary side capacitor 24 divided by N2, where N is the transformer turns ratio, and the symbol "" designates exponentiation. Capacitor 24a is the usual output capacitor whose value is defined in resonant converter patent '730, preferably given approximately by 0.5*Cp/N2, where Cp is capacitance of capacitor 24**, and "*" designates multiplication.

In operation, resonant converter 12 works to charge up output capacitor 10 of the recharge circuit 14. In its preferred operation of a four cylinder engine, the power converter preferably has an output power of approximately 160 watts at close to 80% efficiency for an input voltage of 13 volts and an output voltage 80% of the maximum regulated voltage (i.e. at 300 volts for the preferred maximum regulated voltage of 350 volts). In the context of this disclosure and claims, the term "approximately" means within plus or minus 25% of the value it qualifies, and "close to" means within plus or minus 10% of the value. At typical battery cranking voltage of 10 to 11 volts, power converter output is approximately 100 watts (and efficiency is typically a higher 85% efficiency), allowing for almost constant spark pulse amplitude for the preferred 1 to 20 millisecond (msec) duration multiple spark pulsing ignition firing. At low battery voltage, e.g. 7 volts, sufficient power is provided, e.g. 60 watts, to fully charge the ignition discharge capacitor between firings.

A preferred design for the power converter uses an ETD 34 gapped core for the choke 22 with two layers of Litz wire of approximately total of twelve turns, a transformer based on an ETD 34 or smaller core with side-by-side windings of approximately five primary winding turns. If a layered winding is used instead of a side-by-side winding, then a primary winding with a half integer number of turns (e.g. 5½ turns) is preferable to approximately double the leakage inductance to a value of approximately 1.5 microhenries (uH). Secondary winding comprises preferably number 30 to 36 magnet wire or Litz wire. Capacitor 24 preferably has capacitance in units of microfarads (uF) approximately equal to leakage inductance 21a in uH, for a resonant frequency of approximately 100 kilohertz (kHz). For a conventional 12 volt battery 11 and the preferred primary side ignition voltage Vc of approximately 350 volts, turns ratio of transformer 21 is preferably approximately 20, i.e. between 15 and 25. Note that output voltage Vc is associated with 400 volt capacitor 4 of capacitance C of preferably 3 to 8 uF which is selected with other parameters to insure voltage doubling as per patent '960. For this application, a low cost power converter with output characteristics disclosed above can be attained.

The recharge circuit shown is a higher power recharge circuit than an earlier version disclosed to maintain the spark pulses of a multi pulsing ignition pulsing train at a constant amplitude throughout the ignition firing. This may be especially important because of the higher losses associated with the bi-directional switches of the discharge circuit. Either a diode is used in place of switch 8, in which case capacitor 14 preferably has a capacitance about equal to the capacitance of discharge capacitor 4, where "about" means within 50% of the value and twice the value; or a switch 8 and diode 8a (as shown) may be used, in which case capacitor 10 is preferably an electrolytic capacitor with capacitance of up to several times that of discharge capacitor 4. Output choke inductor 9 is about equal to 16 mH when diode 8 is used, and smaller when switch 8 is used.

Distributorless discharge circuit 16 comprises leakage or resonating inductor 20, of typical inductance Le of approximately 40 uH for 6 uF capacitance of (400 volt) capacitor 4, and in parallel compact coils T1, T2, . . . , with switches S1, S2, . . . Since switches Si are bi-directional switches, there is greater flexibility in selecting the compact coil parameters, versus in the disclosure of U.S. patent application '945, where the switches are one way switches with reverse diodes. For example, if low loss material, e.g. ferrite, are used for the cores of compact coils Ti, then they can be designed to have a leakage inductance of, say, about one quarter that of resonating inductor 20 so that its value in turn may be reduced.

Capacitor 60 (of value about 0.01 uF) and resistor 61 (of value about 20 ohms) comprise snubbing network. High voltage diode 62, resistor 62 (of value about 1 kohms), capacitor 64 (of value about 0.1 uF) and resistor 65 (of value about 150 ohms) comprise speed-up-turn-off circuit as disclosed in patent '925. In operation, one of switches Si is triggered to turn-on in both directions to conduct the sinewave current of approximately 100 usec period and amplitude of approximately 120 and 2 amps for the primary and secondary (spark) sides of the coils respectively, for the values selected for capacitor 4 (capacitance C) and inductor Le and an input voltage of 350 volts, assuming leakage inductance Lpei of compact coils Ti is much less than Le.

Power converter controller 13 preferably uses a 555 timer to control the gate of FET switch 23, with a typical ON-time approximately 4/3 the OFF-time near maximum output voltage of the preferred 350 volts. Preferably, the ON-time is modulated (lowered) with output voltage by having the discharge pin (pin 7 of a LM555J timer) connected to the (350 volt) output voltage through resistors or order of magnitude of hundreds of kohms, with the ON-time being about twice the OFF-time at low output voltage, and dropping to the approximately 4/3 value of the OFF-time at maximum output voltage. For example, for transformer leakage inductance 21*a* of 2 uH, capacitance 24 of 2 uF, OFF-time is approximately 5 usecs, and ON-time is approximately 11 usecs at low output voltage, and approximately 7 usecs at maximum output voltage (of approximately 350 volts). OFF-time is preferably somewhat lowered with lower input voltage.

Voltage regulator circuit 14*a* is any of a number of well known types.

Several input trigger conditioner circuits 15 have been designed with a preferred type disclosed in patent '538. Likewise, a variable gate 17 is disclosed in patent '538. Similar operation to that gate can be achieved using electronic comparators instead of transistors.

A robust variable gate, with a gate time which is a constant fraction of the time between firings, can be achieved by the combination of a 555 timer and an Operational Transconductance Amplifier, or OTA (e.g. a CA3080E or LM3080N OTA). A fractional gate time of approximately 20% is preferred, where fractional gate time is the gate time (gate duration) divided by the time (duration) between spark firings, assuming a four cylinder engine (the reference case of this disclosure, unless otherwise specified). If desired, the fractional gate time can be increased (to say 40%) during engine cranking by using the starter solenoid signal (or other signal if a starterless engine is used). For the spark oscillator 19, there is disclosed a version without stretch in patent '538. A preferred version uses, once again, a 555 timer in combination, this time, with a comparator and a current sink transistor biased by an R-C network. In a preferred design, the output of the oscillator provides spark trigger pulses initially approximately every 300 usecs and increasing to a maximum of approximately 500 usecs at approximately the twentieth pulse.

Finally, steering circuit 21 is preferably based on a ring counter, e.g. a CD4022BE counter, which is useful for up to an eight cylinder engine (the counter has eight outputs). The counter is reset once every engine camshaft revolution by triggering (applying a positive phasing signal to) the reset pin synchronously with an ignition input trigger corresponding to a specific cylinder firing (e.g. cylinder #1 firing). The counter is advanced, to provide sequential cylinder firing, by the rising edge of the gate (created by each ignition triggering signal) which is applied to pin 14 (with pin 13 grounded). The counter outputs continue to advance until a new phasing signal is applied to the reset pin. Clearly, the outputs of the counter is used to trigger each ignition switch Si in the proper (engine firing) order, i.e. cylinders 1,3,4,2 for a typical four cylinder engine. The outputs of the counter are preferably connected to current steering switches (transistors) which control the various switches Si.

FIG. 2 is a preferred embodiment of the distributorless discharge circuit 16 with preferred bi-directional switches comprised of two silicon control rectifiers, or SCRs, and diode means, with like numerals representing like parts with respect to FIG. 1. Also shown is speed-up-turn-off circuit with its connections to the gates (triggers) of SCRs 5*aa* and 5*ba* through diodes 67*a* and 67*b* to provide negative bias to the gates during the SCR firing to speed up their recovery (to the preferred 50 usec half sinusoidal period).

As shown, a bi-directional switch comprises SCR 5*aa* (for the case of coil T1) with its anode connected to one end of primary winding 1 and cathode to ground. In parallel to SCR 55*a* is a series combination of SCR 5*ab* (with its cathode connected to anode of SCR 5*aa*) and a fast diode 6*a* with its anode connected to ground. In operation, SCR 5*aa* is triggered and, prior to or at the beginning of the second half discharge cycle, SCR 5*ab* is triggered to conduct the second half cycle discharge current. Fast diode 6*a* provides the fast turn-off of the second half cycle discharge which SCR 5*ab* is normally unable to provide. The remaining switches are open in both directions so no false firing can occur, i.e. current cannot flow simultaneously in two transformers if only one is triggered. In this preferred embodiment, there is no constraint on the leakage inductance of coils Ti relative to inductance of resonating inductor 20.

FIG. 3 is a fragmentary view of a preferred embodiment of a toroidal gap spark plug suitable for use with this ignition, shown associated with high voltage output 68 of coil T2 (FIG. 2). In this drawing is shown center conductor 81 to which is attached a preferred thin disk electrode 85 of thickness "t" (of preferably about 0.02") and diameter d5 (approximately equal to d3) which forms a toroidal spark gap 7*a* with the end of the spark plug shell 86. Preferably, as disclosed in the referenced patents, the material making up the electrodes is tungsten-nickel-iron, or other erosion-resistant material. Spark plug insulator is comprised of section 83 of length 12 and section 84 of length 11 and respective diameters d3 and d2, with preferred dimensions giiven in the table of FIG. 4.

For this spark plug, we assume the standard 14 mm spark plug and a diameter d4 for the inside shell and a diameter d1 for the center conductor 81. With reference to the table of FIG. 4 cavity 87, represented by the length dimension 12, is preferably larger than typical which may be beneficial in keeping the spark plug clean.

FIG. 3*a* is another fragmentary schematic of the plug shown in FIG. 3, with like numerals depicting like parts with respect to FIG. 3. The main difference here is that the disk electrode 85*a* is of a conical shape with an included angle of approximately 120 degrees which helps focus the high voltage electric field 7*b* from the annular edge 85*b* to the shell edge 86*a*. Such shaping will tend to reduce the gap 7*a* spark breakdown voltage.

FIG. 4 is a table showing the preferred typical value designated "typ." for the parameter shown with reference to the plugs of FIG. 3 and FIG. 3*a* as already discussed. Also shown in the table are preferred minimum and maximum dimensions for the designated parameter.

Figure 5:
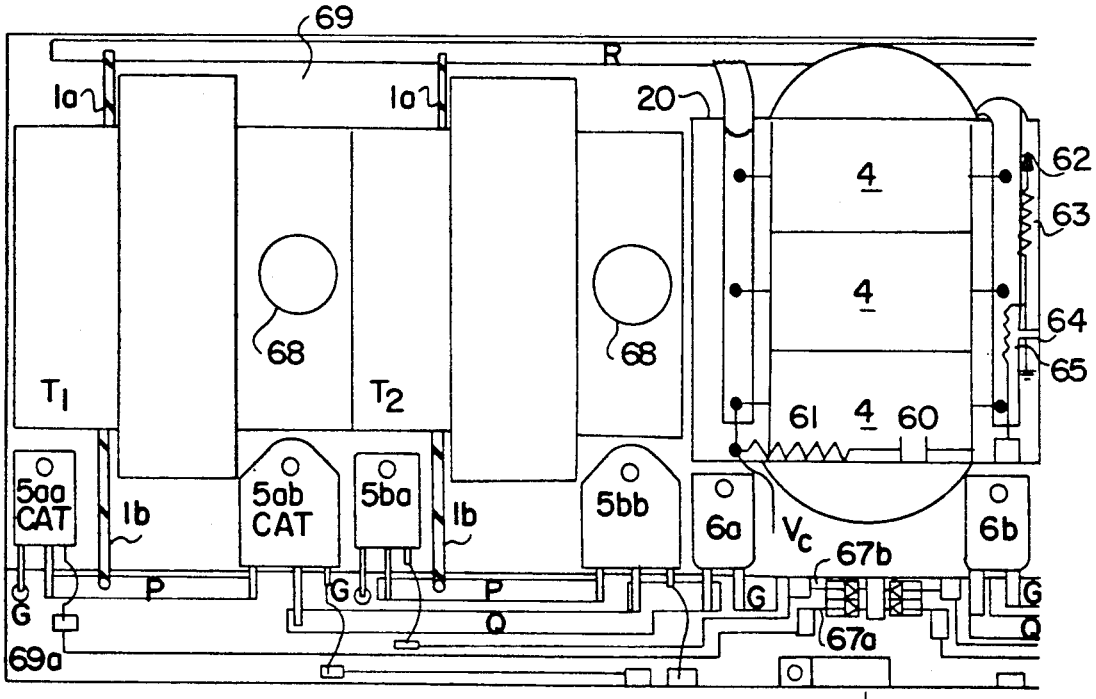
FIG. 5 is a partial top view, essentially full scale drawing of a preferred arrangement of parts for the distributorless ignition with bi-directional switches for a four cylinder engine.

FIG. 5 is an approximately full-scale drawing of a partial top view of a preferred layout of the distributorless discharge circuit 16. The figure is partially fragmentary in that only two of the four coils are shown, it being understood that the other two coils are oriented in the same way about the line of symmetry shown. Like numerals represent like parts with respect to FIG. 1 and FIG. 2. Coils T1 and T2 are depicted as E-I cores with high voltage towers 68.

These cores are encapsulated and have preferably a two-layered primary winding made of copper strip with approximate dimensions 0.03" by 0.16" (or 0.045" by 0.1" if a single layer is used). The two ends of the primary winding 1*a* and 1*b* are shown brought out at 180 degrees from each other onto conducting pad P (to which are connected SCRs 5aa and 5ab referenced to coil T1) and to rail pad R to which is connected the feed voltage Vc and one end of capacitor 4, shown as three in-parallel capacitors in this case. These capacitors are shown mounted on ferrite inductor 20 with preferred values as already disclosed, i.e. approximately 2 uF each for a total of approximately 6 uF (for the assumed preferred 350 volt case).

As can be seen, this layout allows for convenient placement of the various high current carrying components, with the ground high current carrying strip placed on the underside, i.e. the ground copper strip is placed on the underside of the board 69a on which the components are mounted. Preferably, board 69a, in turn, is mounted on a conducting plate 69. The snubber circuit 60/61 and fast-turn-off circuit 62/63/64/65 are preferably placed on a board on top of inductor 20. The SCR's, and the one diode 6a for the two reverse SCRs 5ab and 5bb, are shown conveniently located in the space alongside the coils T1 and T2. The reverse SCRs are preferably high efficiency, low forward voltage drop SCRs such as Motorola MCR265-8 or Teccor S6070W, and diode 6a (and 6b) is a fast turn-off diode as already disclosed. This layout makes for easy installation and accessibility of all the parts. Plate 69 to which SCRs, diodes, coils, and resonating inductor are mounted, also acts as part of (or all of) a heat sink. A top plate (not shown) similarly dimensioned to plate 69 may be used for holding the coils Ti and resonator 20 in place (by sandwiching action), and may also act as a ground plate for high voltage shields if such are used with the spark plug wires (terminating onto towers 68).

Figure 5A:
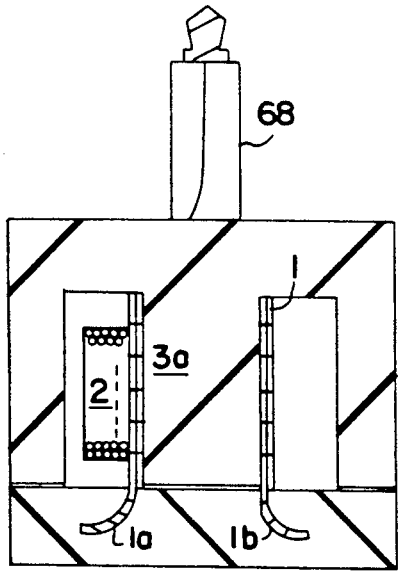
FIGS. 5*a* and 5*b* are side views of preferred laminated E-I cores and U-cores (or C-cores) respectively for the compact coils of FIG. 5.

FIG. 5a shows a preferred embodiment of a compact coil Ti, with like numerals representing like parts with respect to FIG. 1. It is based on a scrapless E-I lamination with dimensions shown, i.e. with E, F, and G dimensions close to ¾", ½", and 1¼" respectively, and the D dimension, corresponding to the E dimension (which together define the core center leg area) being also close to ¾". For twelve turns of primary winding and use of low cost, high frequency 7 mil lamination, a primary inductance of approximately 160 uH at the open circuit frequency of approximately 30 kHz is obtained. For the preferred approximately 40 uH leakage inductor 20 this gives a coupling coefficient of close to 0.8. A turns ratio of approximately 60 is required for a peak output voltage of 33 kilovolts (kV) for the preferred input voltage of 350 volts, i.e. voltage doubling is operating as per patent '960. High voltage tower 68 is of conventional design.

Figure 5B:
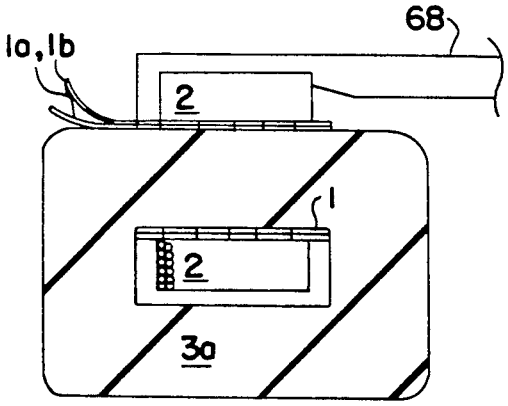

FIG. 5b is a cut (or uncut, if feasible) tape wound C-core or pressed U-core which is approximately to-scale, with like numerals representing like parts with respect to FIG. 5a, and dimensions D, E, F, G similar to that of FIG. 5a. If high permeability, high inductance (at high frequency) material is used for the core material, such as Metglas, nickel iron (Ni-Fe), or very thin silicon iron (SiFe) of thickness less than 8 mil, then dimensions D and E can be approximately ⅝" and provide 200 uH primary inductance at an open circuit frequency of 30 kHz (assuming approximately 12 turns of primary winding). In this design is shown a two layered primary strip winding 1 (with ends 1a, 1b) with approximate dimensions disclosed earlier. The coil turns ratio is approximately 60 as already disclosed (for 350 volts input and 33 kV output), with secondary winding comprised of approximately 720 turns of between #28 to #32 wire preferably wound in approximately 10 layers.

Figure 6:
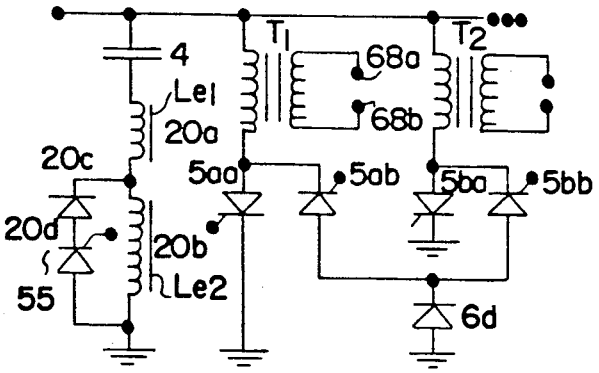
FIGS. 6 and 6*a* are circuit drawings of a preferred embodiment of the invention showing means for shorting all or part of the resonating leakage inductor to permit use of smaller coils.

FIG. 6 is a circuit drawing of a version of the circuit of FIG. 2 with like numerals representing like parts, the additional feature being the inclusion of a switch SS across section 20b of resonating inductor 20 (or across all of it by eliminating inductor 20a). Preferably, switch SS is series combination of SCR 20d and a fast diode 20c.

By turning on switch SS during the first pulse of the ignition sparking pulse train, the voltage across the coil input terminals increased from:

$$[Lp/(Lp+Le)]*Vp$$

$$[Lp/(Lp+Le1)]*Vp$$

where Lp is the coil primary inductance, Le1 is the un-shunted inductance 20a of inductor 20, and Vp (or Vc) is the maximum primary voltage (of preferably approximately 350 volts). For the purpose of this analysis, the coil leakage inductance Lpe can be neglected, except where the entire inductance 20 is shunted, wherein the voltage is increased to:

$$[Lp/(Lp+Lpe)]*Vp$$

which for practical purposes equals Vp since Lpe is typically much less than Lp (and hence Lpe can be neglected).

Likewise, the open circuit frequency foc, which is proportional to:

$$1/[SQRT(Leo*C)],$$

is raised, where SQRT represents the "square root of" the number it qualifies, and Leo is the total circuit leakage inductance.

For laminated coils, where too low a (high frequency) primary inductance Lp, rather than core saturation Bsat, is the (core size) design limitation, then in utilizing switch SS there is a net gain. However, for typical lamination material (such as SiFe), Lp may not be reduced proportionally to the reduction of Le (from Le to Le1), but proportionally to the reduction in the square root. This is because Lp depends inversely on frequency which is proportional to the inverse of the square root of Le. For example, halving Le (i.e. Le1=-Le2) would allow Lp (and hence the core area) to be reduced by 30% (versus 50%) for the same applied voltage at the coil input terminals. This would permit a design using 7-mil lamination (or tape for a tape wound C-core) with D=E=⅝" versus ¾".

For ferrite cores, where the design limitation is core saturation Bsat (and not inductance Lp, which is high even at high frequencies) there would be a considerable gain by shunting all of the inductor 20 with switch SS. For example, assuming Le is 36 uH and Lpe is 4 uH, then the open circuit frequency foc, when entire inductor 20 is bypassed, would increase by a factor of three, and the coil core cross-section can be reduced proportionally (from approximately 1 inch square to approximately ⅓ inch square for twelve turns of primary winding Np and use of a ferrite material with high Bsat of 0.4 Tesla at the maximum operating temperature).

Likewise, the first half cycle (of the first spark pulse, which is preferably the only pulse during which switch SS is turned on) will have a spark current three times normal, e.g. 6 amps versus 2 amps, which will be beneficial for ignition. SCRs 20d and 5 and diode 20c will be able to withstand the peak approximately 400 amp, 18 usec duration primary current, since the duty cycle is minute (typically 1/1000). Increasing Lpe to 8 uH raises the open circuit frequency by close to 2.2 versus 3 and reduces the peak primary current to below 300 amps, versus 400 amps, which may be desirable.

Figure 6A:
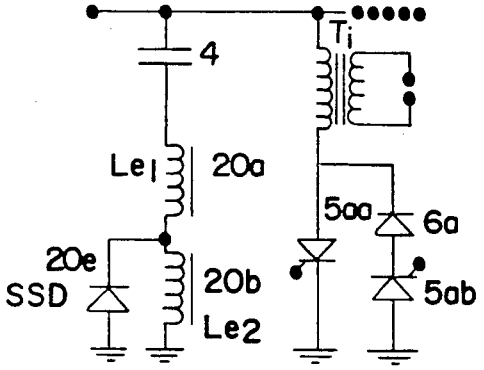

FIG. 6*a* depicts one of several other possible alternative cases of shunting inductor 20, the case where section 20*b* of the inductor is shunted with a diode 20*e* designated as SSD, instead of with a switch SS. In this case, every first half cycle of every spark pulse would operate at a higher frequency, versus the case of FIG. 6 where only the first half of the first pulse of the preferred multi-pulsing waveform would operate at a higher frequency. In this application there is a trade-off of a smaller core of coil Ti and higher first half cycle spark discharge versus greater circuit dissipation. Note that if more than one coil is used, i.e. cascaded as in FIG. 6, then SCR 5*ab* with series diode 6*a* may be required as shown. This topology is also useful for two plugs (coils Ti) per engine cylinder since if diode SSD shunts essentially all of inductor 20, i.e. Le2 is much greater than Le1, then two coils T1 and T2 can be fired simultaneously (through a common switch if required).

In either case, for low loss coil core material such as ferrite, a preferred design is one in which Lpe is approximately ⅓ of Le, and the coil cross-section area is also approximately ⅓ that of inductor Le, assuming approximately equal number of turns Ne of inductor 20 and Np of primary winding of coil T. On this basis, the first half discharge cycle would be approximately one half the second half cycle, which is preferably 50 usecs for SCR recovery requirements, for a total discharge time of close to 75 usecs. In such a design one also gets an optimum sharing of magnetic stress between the two magnetic components, the smaller transformer T and the inductor 20 (which is also made smaller, e.g. one square inch cross-sectional area versus 1½ square inch).

Figure 7:
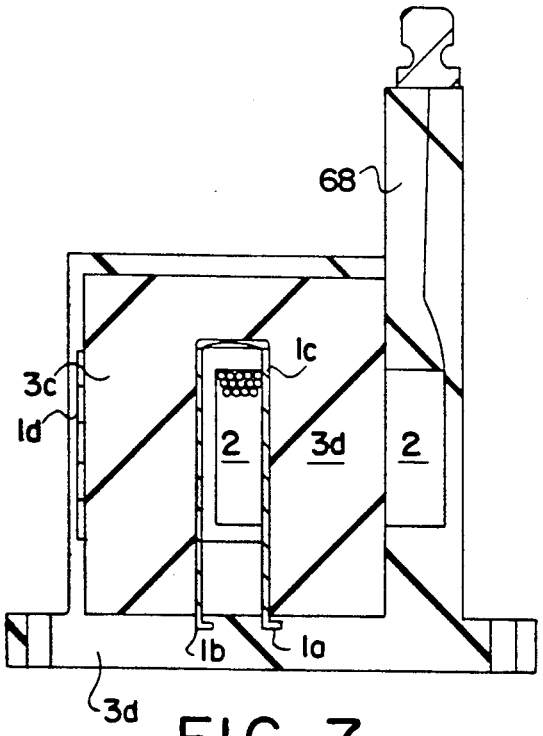
FIGS. 7, 7*a*, 7*b* are side views of preferred compact coils for use with the circuits of FIGS. 6 and 6*a*.

FIG. 7 is a ferrite based coil design utilizing the advantages of the embodiment of FIGS. 6 and 6*a*, and capable of providing the intermediate level of leakage inductance of, for example, about 10 uH, i.e. 5 uH to 20 uH. Like numerals represent like parts with reference to FIG. 5*b*. The design is based on a U core with preferably circular core (3*a*) dimensions D/E approximately equal to ¾" (area approximately equal to 0.4 square inch), and primary winding Np of approximately 12 turns.

In one embodiment, approximately half the primary turns 1*c* are wound concentrically with the secondary winding 2 (of turns Ns approximately 60 times the primary turns Np) and the remaining turns 1*d* are wound on the opposite core leg 3*c* to provide the higher leakage inductance Lpe. However, in order to limit coupling of the leakage magnetic field to external metallic surfaces, preferably a dielectric mounting structure 3*d* is used.

Up to this point, the preferred coil designs disclosed have one high voltage output per coil. An alternative design, which uses the principles disclosed herein, can use two high voltage outputs per coil to conform to the more conventional, lower cost version of (dual output) coil which fires two plugs simultaneously (known as "waste spark" ignition). In that application, only half the coils (and half the switches Si) are required, and the ignition can be triggered via crank, versus cam, trigger signals. In essence, the ends of the secondary winding of the coils Ti (FIGS. 1, 2, 6) are both brought out as insulated high voltage towers, which are connected to the appropriate spark plugs of a multicylinder engine (with an even number of cylinders) such that, in the conventional way, for one coil high voltage end connected to a plug of a first cylinder the other coil end is connected to a plug of a cylinder which is phased to be in the exhaust stroke when the first cylinder is in the compression stroke, i.e. plugs #1 and #4 are connected to one coil and #2 and #3 to another for a four cylinder engine with firing order 1,3,4,2.

Figure 7A:
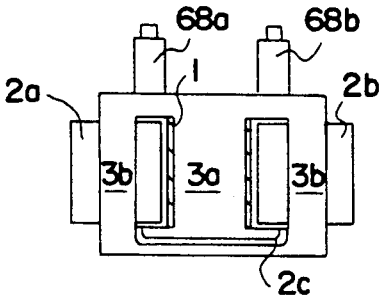

FIG. 7*a* depicts an approximately half scale drawing of a high leakage inductance version of a preferred embodiment of such a dual-output coil in which the secondary winding is split into two windings 2*a*, 2*b* with high voltage outputs 68*a*, 68*b* (see FIG. 6) and with the windings connected via (intermediate voltage) wire 2*c* and wound in the magnetic sense such that the two winding voltages add. The core preferably is a ferrite E-core with round center post 3*a* and round outer posts 3*b* (of half the area of post 3*a* as is usual). This embodiment will have a higher leakage inductance and the advantages pointed out with reference to FIGS. 6 and 7. Preferred dimensions for the winding window F and G are approximately ½" and 1¼", and that of the center post 3*a* (D/E) is approximately ¾" for approximately 12 turns of primary winding 1.

Figure 7B:
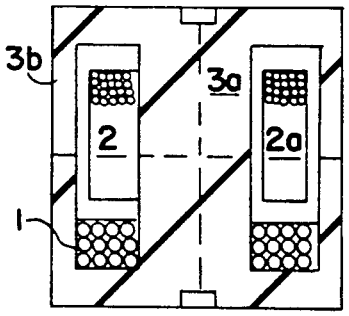

A preferred way of confining a higher leakage field for either single or dual output coils is shown in FIG. 7*b* with reference to an E-core (or variants of it). In this drawing, each core half about the center line represents a secondary winding option, secondary winding 2 representing the single high voltage output option, and secondary winding 2*a* representing the dual output option where the inner secondary layer is insulated from the core. The primary winding 1 is wound entirely at one end, representing a side-by-side winding with maximum leakage inductance Lpe, which may be particularly useful for the case where a somewhat higher overall leakage inductance Leo is desired, e.g. for an Leo of 60 uH (based on a capacitance C of 4 uF for discharge capacitor 4, giving the preferred desired spark discharge oscillation frequency of 10 kHz). In such a case, Lpe could be 12 uH to 18 uH, or 0.25 to 0.42 to of Le. For the case where such a coil is directly plug mounted, and high voltage output capacitance Cs is small, e.g. 60 picofarads (pF), capacitor C can be reduced to a value of approximately 4 uF while still maintaining voltage doubling, wherein maintenance of voltage doubling is defined as having the parameter (N**2)*Cs/C be less than 0.2 . Note that low Cs also raises the open circuit frequency foc and thus permits an even smaller core area for the coil Ti.

For this plug mounted case, a standard ETD 49 E-core with twelve turns of primary wire can satisfy the Bsat conditions (as per equations 5, 6, 7, . . . , in patent application '945). For a non-plug mounted coil, a slightly larger core is preferred with dimensions close to the following: D/E=¾", F=7/16", G=1.5". The primary winding 1 employs approximately twelve turns Litz wire of diameter approximately 0.1" wound as a three by four stack.

The key features of the present invention are summarized here and can be viewed as a voltage doubling, very high power, very high energy ignition system of variable spark duration of the preferably distributorless type for use in IC engines for igniting difficult-to-ignite mixtures. The ignition features ignition coil assemblies with single resonating inductor and compact ignition coils Ti of low to moderate leakage inductance and low, shorted output, 10 kHz AC equivalent resistance of preferably less than 20 milli-ohm, wherein the size and cost of the ignition coils are minimized by using bi-directional switches Si in conjunction with the operation of said ignition coils and a shunt switch SS across part or all of the resonating inductor (of preferably less than 10 milliohms, 10 kHz, AC resistance) which reduces discharge circuit inductance during the initial spark breakdown phase. The invention further features power converter, recharge circuit, and control circuitry, including steering circuit, to provide variable spark duration with multiple spark pulses per ignition firing of approximately constant amplitude in the range of amps of spark current provided by said distributorless ignition.

For the power converter, preferably the current pump resonant converter is used with its typical approximately 100 watts output power at 80% efficiency at full output voltage of 350 volts, and its higher, i.e. approximately 200 watt, output power at the lower voltage of approximately 250 volts, i.e. at the 200 to 300 volts of the recharge capacitor encountered during the spark firing period.

For the discharge circuit, preferably, 5 to 6 uF capacitance C, 400 amp (approximately equal length to diameter ratio) polypropylene 400 volt capacitors are used for the discharge capacitor, and approximately 50 uH inductor for the leakage inductor in conjunction with coils Ti of approximately 60 turns ratio, and bi-directional switches Si and shunt switch SS comprised of SCRs and fast diodes with peak current capability of 400 amps, the discharge circuit operating to produce primary winding coil current Ip of 100 to 125 amps peak and secondary peak spark currents Is of approximately 2 amps. During operation of shunt switch SS, preferably only on the first half cycle of the first spark pulse, the breakdown spark, of the train of spark pulses comprising an ignition firing, currents Ip and Is are approximately 2½ times the normal currents (when switch SS is inoperative). Other features of the invention include design of coils to utilize the advantages of the switched resonating inductor, and improved toroidal gap spark plugs to advantageously use the variable duration constant amplitude spark pulses.

Figure 8:
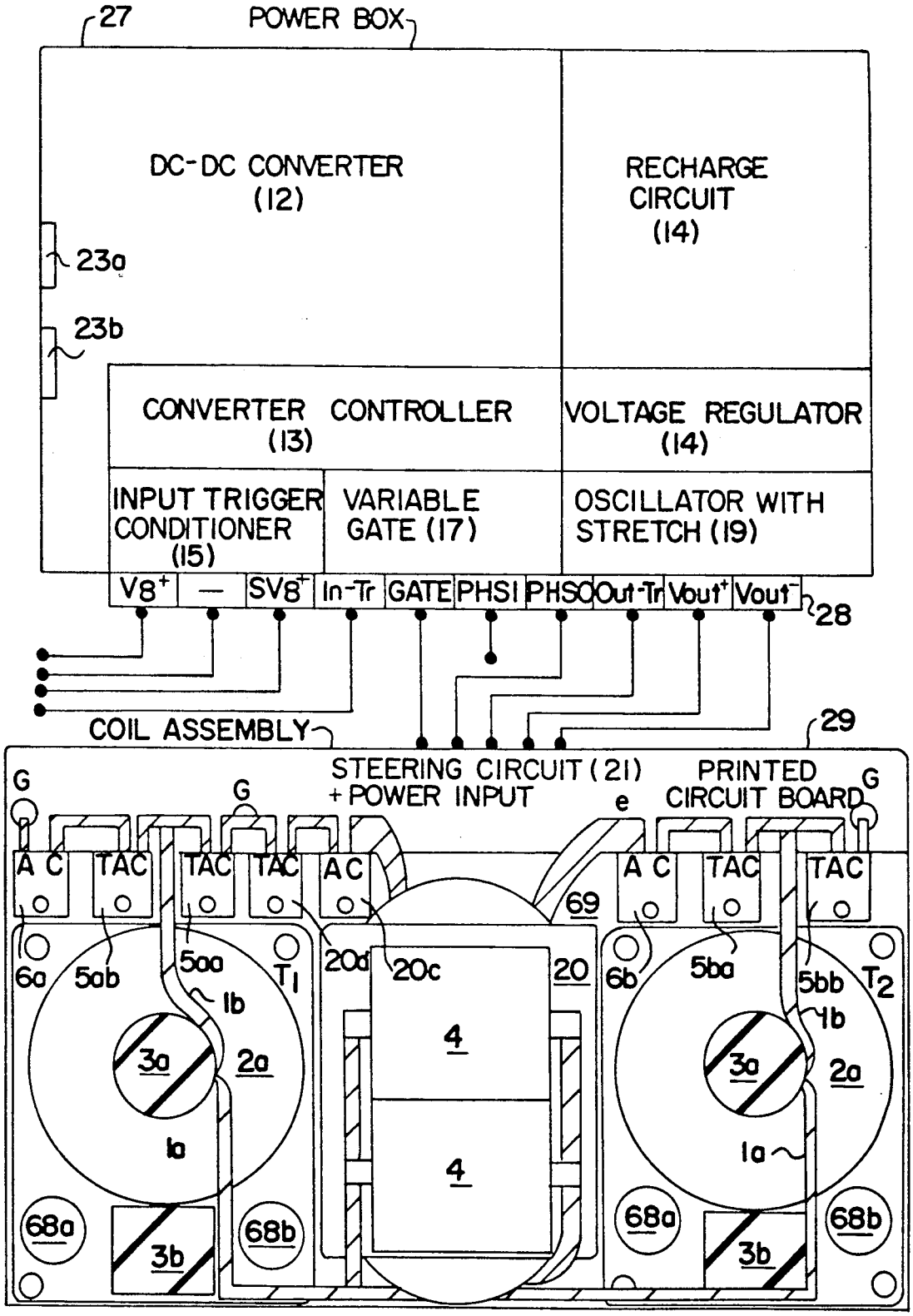
FIG. 8 is an approximately to-scale overall dimensioned top view of a partially schematic, partially block diagram of simplified distributorless ignition comprised of a power box and coil assembly.

FIG. 8 depicts in partially schematic, partially block diagram of an ignition incorporating the above features for the dual output coil, or double spark ignition, or DSI, system as it may also be referred to. The power box 27 and coil assembly 29 (made up of two dual output coils T1, T2 for a four cylinder engine) are approximately to scale. Like numerals represent like parts referenced to FIGS. 1 and 5. Connector strip 28 connects the battery input "Vb", the battery return "−", the switched 12 volts "SVb", the tigger input "In-Tr", the input and output crank or cam phasing reference signals "PHSI" and "PHSO", the trigger output "Out-Tr", the spark firing duration "GATE", and the output primary circuit high voltage (350 Volt) "Vout+" and its return "Vout−". FET switches 23*a* and 23*b* are preferably case mounted as shown.

The steering circuit 21 is shown mounted on the coil assembly 29 in the preferred location adjacent to the resonating inductor and capacitor combination 20/4. In the schematic are shown coils T1 and T2 in the preferred embodiment employing U-cores, and with preferred orientation and preferred break-out of the primary wires (as per FIG. 5). E-cores, or other cores, can also be used for coils T1, T2. For the preferred U-core structure window dimensions F and G are approximately ¾" and 1.25" respectively and the core post 3*a* on which the primary is wound is approximately ¾" diameter round, and the post 3*b* is approximately ¾"×0.6" (the ¾" dimension corresponding to the diameter of post 3*a*). The high voltage towers 68*a*, 68*b* are shown located adjacent to the end (versus central) core 3*b* on the back side of the coil assembly (wherein the various switches define the front side).

The switches 5*aa*/5*ab*/6*a* and 20*c*/20*d* are located in front of one coil (T1 in this case), and switches 6*a*/5*bb*/-5*ba* in front of the other coil (T2 in this case) leaving a larger central area in front of the resonating inductor 20 for the steering circuit 21. See FIG. 6 for circuit designation of the various switches, shown here with their cases connected to the base plate 69 and their connecting legs soldered to a printed circuit board (PCB) to which all other connections are made for a preferred design of the overall layout. The underside of the PCB has wide ground paths to which various legs of the switches are connected, designated as a circle and the letter "G". Ends of resonating inductor section 20*b* (FIG. 6) are also conveniently located and connect to the switches 20*c*/20*d* via the single PCB.

While the preferred application of the distributorless feature of this ignition invention is disclosed with reference to the voltage-doubling, multipulsing, capacitive discharge ignition system of the various patents cited, the plasma jet ignition of patent '068 can also be improved by using an alternative circuit topology and the distributorless ignition feature disclosed herein.

Figure 9:
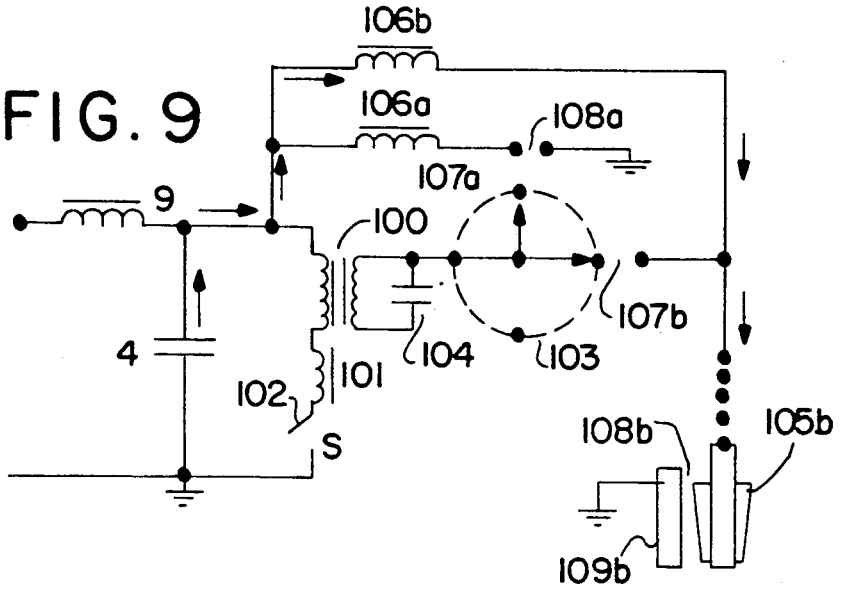
FIGS. 9 and 9*a* are alternative topology plasma jet ignition capable of handing and more efficiently delivering the very high plasma jet current in a distributor and distributorless version.

FIG. 9 depicts a preferred (alternative) topology for the plasma jet system of patent '068 (which is a distributor ignition). The principal advantage is that the plasma jet current (shown by means of arrows) for this topology does not pass through switch S (102) and hence much higher currents can be tolerated, i.e. many hundreds of amps of peak current. By-pass inductors 106*a*, 106*b* can be small, e.g. 10 uH, so that assuming discharge capacitor 4 is 10 uF (for a source impedance of 1 ohm), and it is charged to the usual 350 volts, then the peak plasma jet current will be 350 amps. Reducing the by-pass inductor values to 5 uH and the discharge capacitance to 5 uF which is now charged to a higher voltage of 600 volts, and insuring output capacitor 104 is sufficiently high, i.e. about 500 pF as disclosed in patent '068, then peak currents of 600 amps are attained, which in combination with conductor rails 105*b*, 109*b* defining gap 108*b* (of preferably approximately 0.1" dimension) produces a high speed jet which can move at a speed of many mm/10 usec, where 10 usec is the time constant for the above values of capacitance and inductance.

In the figure, gaps 107*a*, 107*b* are the auxiliary gaps (as per patent '068) which may be internal or external to the distributor 103, and the coil 100 is a more conventional low current coil with a leakage inductor 101 which can be either built into the coil or placed external to it as a separate circuit element, or both. Leakage inductance 101 should be much greater than the value of the by-pass inductances so that the capacitor (4) voltage Vc has not significantly decayed through primary winding of coil 100 during one discharge cycle of the capacitor and by-pass inductors. Value of leakage inductance 101, alternatively, can be selected to control the number of discharge cycles through the by-pass inductors.

Figure 9A:
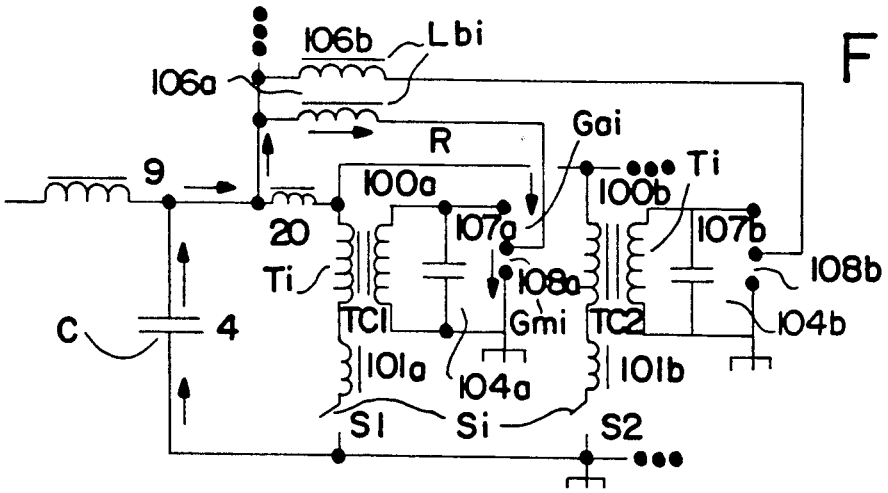

FIG. 9*a* is a circuit drawing of a distributorless version of the plasma jet ignition of FIG. 9 with like numerals reepresenting like parts. Coils TC1 and TC2, as stated, are low current coils since their main function is to produce the high breakdown voltage to electrically break down the auxiliary gaps 107*a*, 107*b*, . . . , and the plasma jet gaps 108*a*, 108*b*, . . . . Resonating inductor 20 (which may or may not be required depending on the value of the leakage inductances 101*a*, 101*b*, . . . ) is located so as not to be in series with the plasma jet current but in series with the primary current of the coils TCi. Typically, total leakage inductance Le (of resonator 20 and coil TCi) should be about ten times greater than by-pass inductance. Assuming capacitance C (of capacitor 4) is 8 uF, by-pass inductances are 10 uH, voltage Vc is 350 volts (producing peak plasma jet current of approximately 300 amps), and output capacitance Cs (of capacitors 104*a*, 104*b*) is 500 pF, then a turns ration 60 of coils Ti will produce a peak output voltage of 33 kV.

It should be noted that since coils TCi deliver little inductive, i.e. high current, power they can have relatively (to coils Ti) high AC resistance. Hence, they can be of low cost construction. Moreover, for a by-pass inductance of 10 uH, if the coil leakage inductance is, say, 40 uH, then resonating inductance of approximately equal value or greater, i.e. 40 uH or greater, will suffice. Coil TCi primary inductance should be approximately equal to or greater than ten times the leakage inductance Le.

Figure 10:
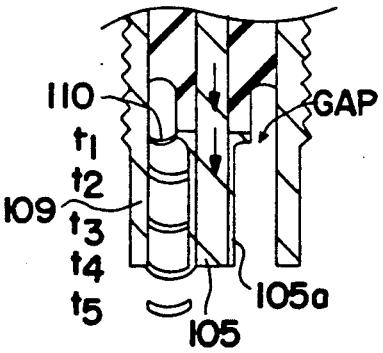
FIG. 10 is a variant plasma jet spark plug designed to take advantage of the improved features of the plasma jet ignitions of FIGS. 9 and 9*a*.

FIG. 10 is an approximately to-scale, side view of a spark plug end more optimized to work in conjunction with the circuits of FIGS. 9 and 9*a*. The parallel conductors 105/109 comprise a more optimal "pair of rails" as disclosed in lines 13, 14, PP. 8, plasma jet patent '068 with reference to FIG. 4 of that patent, and also in FIG. 6*a*, patent '960. In this case the rails are shown to be of length "l" of approximately ⅜" and separated by approximately ⅛", except at the sparking "gap" at the base of the rails which are preferably approximately 0.080". The plasma arc 110 is shown at various travel times t1 through t5 as it moves out of the plug end and into the combustion chamber.

Figure 10A:
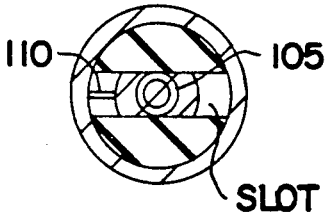
FIG. 10*a* is a preferred embodiment side view of the plug end.

The length section "l" of the rails may be open (as in FIG. 66*a* of '960), or closed (as in FIG. 4 of '068) as depicted herein in FIG. 10*a*, showing an end view. Assuming a diameter of approximately ⅛" for the center conductor 105, then the slot width "w" would also preferably be approximately ⅛", which would speed up the arc motion by a factor of somewhat less than two as disclosed in patent '068. Conductor rail 105 is preferably comprised of erosion resistant material, or of a layer 105*a* of such material.

With regard to spark plug wires for interconnecting output of coils Ti to spark plugs, preferably shielded wire is used as disclosed in some of the patents cited to both shield EMI as well as to deliver the maximum capacitive spark.

Finally, it is particularly emphasized with regard to the present invention, that since certain changes may be made in the above apparatus and method without departing from the scope of the invention herein disclosed, it is intended that all matter contained in the above description, or shown in the accompanying drawings, shall be interpreted in an illustrative and not limiting sense.

What is claimed is:

1. A capacitive discharge ignition system comprising:

(a) at least one energy storage and discharge capacitor C, (b) at least one resonating inductor means of inductance Le, (c) at least two ignition coils Ti, each of said coils being separate from the said resonating inductor means, (d) ignition coil primary current switch means Si for each coil Ti, and (e) DC power source means for supplying power to the ignition system by charging up said capacitor C, the switch means Si comprising high current bi-directional switch means constructed and arranged to control, in both directions, primary discharge current Ip flowing in the primary windings of said coils Ti.

2. An ignition system as defined in claim 1 further comprising high current switch control means SS constructed and arranged to controllably short out part or all of inductor Le during part or all of the firing of said ignition system.

3. A capacitive discharge ignition system comprising:

(a) at least one energy storage and discharge capacitor C, (b) at least one resonating inductor means of inductance Le, (c) at least two, ignition coils Ti (d) ignition coil primary current switch means Si for each coil Ti, and (e) DC power source means for supplying power to the ignition system by charging up said capacitor C, the system further including high current control means SS constructed and arranged to controllably short out at least part of inductor Le during at least part of the firing of at least one of the ignition discharge circuits.

4. An ignition system as defined in claim 2 wherein said switch means Si comprises a first silicon control rectifier, SCR, switch with its cathode connected to ground and a return current switch SD connected across said first switch, return switch SD comprised of a series combination of SCR and fast diode, and wherein said switch means SS comprises a series combination of SCR and fast diode means, constructed and arranged to be triggered simultaneously with triggering of one or more coils Ti producing the initial high voltage breakdown field to produce an initial breakdown spark in a spark ignition device connected across the secondary winding of each coil Ti.

5. An ignition system as defined in claim 4 wherein said discharge circuit comprises the series connection of: 1) the resonating inductor Le with one of its ends connected to ground, 2) the said capacitor C, 3) the primary winding of a coil Ti, and 4) said switch Si with one of its ends connected to ground.

6. An ignition system as defined in claim 5 wherein one resonating inductor Le is used with more than one coil Ti with respective switch Si in series with primary winding of each coil Ti, said coils cascaded in parallel with each other with one end of their primary windings sharing a common rail point or section R, the system used to sequentially fire said spark ignition devices when each bidirectional switch Si is triggered sequentially.

7. An ignition system as defined in claim 6 wherein the parameters defining said ignition system are selected to provide voltage doubling, defined as the parameter (N**2)*Cs/C being less than 0.2, wherein N is the ratio of turns of the secondary-to-primary winding of coil Ti and Cs is the total output capacitance of the secondary circuit connected to the high voltage output of said coils Ti.

8. An ignition system as defined in claim 7 wherein said discharge capacitor is 400 volt capacitor of capacitance between 3 and 8 uF and said leakage inductor has inductance Le such that when taken with said capacitor C they have a resonant frequency fcc of approximately 10 kHz.

9. An ignition system as defined in claim 8 wherein C is approximately 5 uF, Le is approximately 50 uH, capacitor C is charged to a voltage of approximately 350 volts, and coil Ti turns ratio N is approximately 60, and wherein speed-up-turn-off circuit comprised of series combination of high voltage diode, resistor, and capacitor with cathode of diode connected to point between said discharge capacitor C and resonating inductor Le, said circuit including additional resistor and isolating diodes for making connections to triggers of said first SCRs of switches Si to apply negative bias to said triggers to speed-up turn-off of said first SCRs.

10. An ignition system as defined in claim 7 wherein ignition is fired in a gate operated multi-pulsing mode with multiple spark pulses per ignition firing of gate duration approximately 20% for a four cylinder engine as a reference case.

11. An ignition system as defined in claim 10 wherein ignition circuit includes a recharge circuit comprised of a capacitor of capacitance Cr between ¼ and one times the value of capacitance C, an inductor Lr of inductance between 8 and 24 milli-Henry, and a diode, said recharge circuit operating in conjunction with discharge of capacitor C to maintain the level of energy on capacitor C at approximately a constant value during the gate operated multiple pulsing.

12. An ignition system as defined in claim 11 wherein said multi-pulsing is controlled by a spark oscillator-with-stretch to provide initial spark pulses at approximately every 300 usecs, i.e. between 220 and 380 usecs, increasing to a maximum of approximately 500 usecs, i.e. 375 and 625 usecs.

13. An ignition system as defined in claim 6 wherein said coils Ti have cores with winding window dimension of length G approximately 1 ¼" and height F approximately ⅜" with approximately twelve turns Np of primary wire, i.e. Np is between 9 and 15.

14. An ignition system as defined in claim 13 wherein ½ or more of inductor Le is shorted out when switch SS is activated and wherein coil Ti core material is ferrite with cross-sectional area between 0.3 and 0.5 square inch.

15. An ignition system as defined in claim 14 wherein said cores are U-cores with round post of diameters approximately ¾" on which coil Ti primary and secondary coil windings are wound, and wherein said coils Ti and their respective switches Si, inductor Le and switch SS, capacitor C, and other components are mounted on a base plate of a coil assembly structure to which is also mounted a printed circuit board, PCB, used for making interconnections between said various components defining a distributorless ignition system.

16. An ignition system as defined in claim 15 for a four cylinder engine wherein resonating inductor comprises a ferrite core with approximately twelve turns of litz wire wound on an area of approximately 1½ square inch, and wherein coils Ti are comprised of four coils T1, T2, T3, and T4 with single high voltage outputs.

17. An ignition system as defined in claim 15 comprised of two coils T1 and T2 with dual high voltage outputs placed in a line about the resonating inductor Le with all high current interconnections made to said PCB excepting for one of the two coil primary winding connections made behind the PCB to said common rail connection R connected to one end of the discharge capacitor C and the output of said power converter.

18. An ignition system as defined in claim 4 wherein said spark ignition device is spark plug comprising a center conductor to which is attached a thin disk of erosion-resistant material of thickness between 1/64 and 1/6 inch which forms a toroidal spark gap of gap width about 0.1" with the end of the spark plug shell.

19. An ignition system as defined in claim 18 wherein said disk is conical in shape with an included angle of approximately 120 degrees which helps focus high voltage electric field onto said shell edge.

20. An ignition system as defined in claim 3 wherein said high current control means SS is a diode means.

21. An ignition system as defined in claim 20 usable in an engine with two coils per engine cylinder wherein said diode means is across essentially entire resonating inductor and wherein said two coils per cylinder are fired in pairs.

22. An ignition system as defined in claim 3 wherein said high current control means SS is a series diode and SCR.

23. A capacitive discharge plasma jet ignition system including at least one energy storage and discharge capacitor C connected to at least two ignition coils Ti via a common rail connector R, with coil Ti leakage inductance Lpei connected in series with capacitor C along the rail R, each coil Ti including a series switch Si in its primary coil winding circuit and also including a by-pass inductor Lbi connected between an end of the coil primary winding via rail R and the high voltage secondary of the coil Ti through an auxiliary gap Gai, the circuit being constructed and arranged such that when each coil Ti is fired by means of its switch Si the gap Gai breaks down and places high voltage on one end of its associated by-pass inductor Lbi which in turn fires a main gap Gmi whereupon capacitor C discharges its energy through a path which includes the capacitor C, by-pass inductor Lbi and main gap, and does not include switch Si.

24. The plasma jet ignition system as defined in claim 23 and further comprising means defining a common resonating inductor constructed and arranged to supplement the inductance Lpei of each coil Ti.

25. The plasma jet ignition system as defined in claim 24 wherein said by-pass inductance is about 10 uH, i.e. between 5 and 20 uH, and discharge capacitor is 400 volt capacitor of capacitance about 10 uF.

26. A plasma jet ignition system as defined in claim 24 including a plasma jet plug comprising coaxial rail section of length 1 approximately ⅜" wherein the central cylindrical conductor of approximately ⅛" diameter is separated by approximately ⅛" from the outer rail section and wherein the space between the rails is partially filled to define a slot of width approximately ⅛" along which the arc moves.

27. The plasma jet ignition system as defined in claim 24 wherein "i" is greater than one, i.e. more than one coil Ti si used, and Si are bi-directional switches.

28. The plasma jet ignition system as defined in claim 26 wherein the space between said rails define main gap Gmi wherein an arc of peak current about 300 amps, i.e. 150 to 600 amps, is formed to move rapidly along said rails.

* * * * *